US011117688B2

(12) United States Patent
Bonati et al.

(10) Patent No.: US 11,117,688 B2
(45) Date of Patent: Sep. 14, 2021

(54) APPARATUS AND METHOD FOR FILLING CONTAINERS WITH A SHAPED FOODSTUFF PRODUCT

(71) Applicant: John Bean Technologies S.p.A., Parma (IT)

(72) Inventors: Roberto Bonati, Sorbolo (IT); Massimo Reggiani, Bardi (IT)

(73) Assignee: John Bean Technologies S.p.A., Parma (IT)

( * ) Notice: Subject to any disclaimer, the term of this patent is extended or adjusted under 35 U.S.C. 154(b) by 196 days.

(21) Appl. No.: 15/581,995

(22) Filed: Apr. 28, 2017

(65) Prior Publication Data

US 2018/0312281 A1 Nov. 1, 2018

(51) Int. Cl.

| | |
|---|---|
| ***B65B 1/24*** | (2006.01) |
| ***B65B 25/06*** | (2006.01) |
| ***B65B 3/12*** | (2006.01) |
| ***B65B 57/02*** | (2006.01) |
| ***B65B 57/00*** | (2006.01) |

(52) U.S. Cl.

CPC ..... *B65B 1/24* (2013.01); *B65B 25/061* (2013.01); *B65B 57/00* (2013.01)

(58) Field of Classification Search

CPC ..... B65B 1/24; B65B 25/061; B65B 63/02; B65B 63/026; B65B 57/02; B65B 57/00; B65B 3/12

USPC ..... 53/517, 529, 530

See application file for complete search history.

(56) References Cited

U.S. PATENT DOCUMENTS 3,164,857 A * 1/1965 Sennello ..... B65B 57/14 452/150
3,611,951 A * 10/1971 Sloan ..... B30B 11/227 425/151
3,722,403 A * 3/1973 Longo ..... B09B 3/0025 100/49
4,116,600 A * 9/1978 Dutton ..... B65B 25/061 100/218
4,126,704 A * 11/1978 McCarthy ..... A22C 7/00 426/304
4,166,140 A * 8/1979 Dutton ..... B65B 25/061 425/296

(Continued)

OTHER PUBLICATIONS

CSI 6500 Machinery Health Monitor, Linear Variable Displacement Transducer (LVDT) Specifications, Aug. 2011 (Year: 2011).*

*Primary Examiner* — Thomas M Wittenschlaeger
(74) *Attorney, Agent, or Firm* — Christensen O'Connor Johnson Kindness PLLC

(57) ABSTRACT

An infeed chamber or channel 12 receives fish fillets 17 from a conveyor belt 13 of an infeed system 14. A plunger 16 pushes the fish 17 upwardly from the infeed channel 12 into an upper compression chamber 18 which includes one or more cavities or lobes 20 into which the fish is pushed by the plunger 16 thereby to fill the lobes 20. Pistons 28 are advanced into the lobes to eject the formed fish cakes 24 out of the lobes and into container cans 30. The end position of the plunger 16 is monitored and measured, and the control system utilizes this information to operate the feed system wherein the fish fillets 17 are loaded into the infeed chamber. In this manner, the volume of fish 17 loaded into the infeed chamber can be controlled so that at the end of the plunger stroke, only a minimum amount of fish 17 remains within the compression chamber 18, thereby avoiding the residual fish 17 to be compressed more than twice.

17 Claims, 3 Drawing Sheets

(56) References Cited

U.S. PATENT DOCUMENTS 4,229,859 A * 10/1980 Gagliardi, Jr. ..... A22C 7/00 100/222
4,269,115 A * 5/1981 Gattyan ..... B30B 9/3003 100/179
4,273,789 A * 6/1981 Zimmerman ..... A22C 7/00 264/40.5
4,781,066 A * 11/1988 Pope ..... B67D 7/18 73/239
4,961,446 A * 10/1990 Berg ..... B65B 25/061 141/137
5,203,141 A * 4/1993 Berciga ..... B65B 25/061 53/435
5,285,828 A * 2/1994 Mihail ..... B65B 25/061 141/71
5,689,941 A * 11/1997 Gombos ..... A23N 17/005 53/529
5,755,078 A * 5/1998 Hurtig, Jr. ..... B60R 21/237 493/409
6,085,486 A * 7/2000 Hunter ..... B30B 9/3007 100/17
6,526,731 B1 * 3/2003 Hunter ..... A01F 15/005 100/17
8,381,499 B2 4/2013 Parisini et al.
8,950,574 B2 * 2/2015 May ..... B65B 25/065 198/750.8
2002/0069621 A1 * 6/2002 Bellavere ..... B65B 25/061 53/517
2002/0069622 A1 * 6/2002 Berciga ..... B65B 25/061 53/517
2002/0104441 A1 * 8/2002 Sowden ..... A47J 31/3614 99/277
2003/0226336 A1 * 12/2003 Hunter ..... B30B 9/3078 53/502
2004/0011005 A1 * 1/2004 Daoust ..... B65B 11/40 53/436
2005/0014459 A1 * 1/2005 Simon ..... A22C 25/18 452/35
2011/0023413 A1 * 2/2011 Suzuki ..... B65B 49/10 53/131.5
2013/0309347 A1 * 11/2013 Roessler ..... B30B 9/3096 425/406
2014/0047804 A1 * 2/2014 Evans ..... B65B 5/101 53/473
2014/0342072 A1 * 11/2014 Van Gerwen ..... A23L 13/00 426/513
2016/0297554 A1 * 10/2016 Hashimoto ..... B65B 9/20

* cited by examiner

APPARATUS AND METHOD FOR FILLING CONTAINERS WITH A SHAPED FOODSTUFF PRODUCT

BACKGROUND

The present invention relates to an apparatus and method for filling a container with a shaped foodstuff product, for example, filling a canning container with fish, including tuna or salmon.

In current systems and methods for canning fish and other food items, a conveyor belt carries the fish or food product to a canning station. At the canning station, the leading end(s) of the fish fillets or food items are fed into a receiving chamber. Thereafter, the portion of the fillet/food item inserted into the receiving chamber is sheared from the rest of the fillet/food item. Next, the fish/food item is transferred into a compression chamber from receiving chamber with a sliding plunger. The compression chamber includes one or more cavities sized and shaped to correspond to the size and shape of containers to be filled. The cavities are oriented transverse to a direction of movement of the sliding plunger. The plunger pushes against the fish/food to force the fish/food item into these cavities. Thereafter, ejection pistons push the fish/food out of the compression chamber cavities and into cans or other containers positioned in registry with the cavities. Once the cans have been filled with fish/food items, they are transported to other locations for further processing, for example, for adding oil, water, or other liquid to the cans and then applying a cover to the cans.

One drawback of existing apparatus and methods for filling cans with fish or other foods is that the fish/food may be compressed several times before it is actually placed within the cans. This occurs because leftover pressed fish/food remains in the compression chamber after the cans have been filled. The amount of fish/food loaded into the compression chamber by necessity is greater than the volume needed to fill the cans. This is to ensure that there is sufficient fish/food in the compression chamber to fill the cans.

The amount of leftover fish/food in the compression chamber increases with each filling cycle and is added to the leftover fish/food from prior compressions of the fish/foods into the compression chamber. Thus, as the amount of leftover fish/food in the compression chamber grows with each cycle, the fish/food may have been compressed at least several times before being placed into the cans. By the time the fish/food has been subjected to several compressions and eventually placed into a can, the appearance of the fish/food has been significantly compromised. In this regard, the compression cycles applied to the fish cause loss of the texture and natural appearance of the fish. Also, the ability of the fish to receive and absorb oil, water, or other liquids when within the can is affected. The present apparatus and method seeks to address the foregoing shortcomings of existing fish/food canning apparatus and methods.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

An apparatus for filling canning containers with fish or other foodstuff comprises: a receiving channel for receiving the foodstuff; a compression chamber in registry with the receiving channel, the compression chamber having one or more foodstuff receiving cavities; a plunger for advancing movement of the foodstuff from the receiving channel into the compression chamber and into the compression chamber cavities; ejectors slidably engageable into the compression chamber cavities for ejecting the foodstuff from the cavities and into a canning container position in registry with the one or more cavities; a monitoring system for monitoring the movement of the plunger relative to the receiving channel and compression chamber; and a control system to control movement of the plunger relative to the compression chamber and receiving channel and stop the advancing movement of the plunger at a desired location relative to the compression chamber.

In a further aspect, the control system includes a linear displacement measurement device extending along the direction of travel of the plunger.

In a further aspect, the linear displacement measurement device comprises: a stationary signal generator extending along the direction of travel of the plunger; and a sensor mounted to travel with the plunger to produce an output signal corresponding to the location of the plunger relative to the receiving channel and the compression chamber.

In a further aspect, a control system is adjustable to set the end point location of travel of the plunger relative to the compression chamber.

In a further aspect, the control system is adjustable to stop the movement of the plunger relative to the compression chamber so that a minimum amount of foodstuff remains in the compression chamber at the end of the plunger stroke.

In a further aspect, the control system is operable to control the amount of foodstuff that is fed into the infeed chamber depending upon the stop location of the plunger relative to the compression chamber.

In a further aspect, the plunger is powered by a brushless linear actuator wherein the travel of the plunger and/or the force imposed on the plunger by the linear actuator can be monitored and controlled.

In a further aspect, the linear actuator is in the form of a brushless linear actuator.

An apparatus for canning foodstuff, such as fish, comprises: a receiving channel for receiving sliced pieces of the foodstuff; a compression chamber in registry with the receiving channel, the compression chamber comprising one or more foodstuff receiving cavities; a plunger for transferring the foodstuff from the receiving channel into the compression chamber, including into the one or more compression chamber cavities; the plunger being powered to travel in a compression stroke through the compression chamber to force the foodstuff into the one or more foodstuff receiving cavities; an ejector slidably engageable into the one or more compression chamber cavities for ejecting the foodstuff from the one or more cavities into a canning container positioned in registry with the one or more cavities; and a control system to control the end of the movement of the plunger during the compression stroke.

In accordance with a further aspect, the control system comprises a linear displacement measurement device.

In accordance with a further aspect, the linear displacement measurement device extends along the direction of travel of the plunger to monitor the movement of the plunger during the compression stroke.

In accordance with a further aspect, the linear displacement measurement device comprises: a stationary signal generator extending along the direction of travel of the plunger; and a sensor mounted to travel with the plunger to produce an output signal corresponding to the location of the plunger relative to the receiving channel of the compression chamber.

In a further aspect, the control system is adjustable to set the end point location of the travel of the plunger relative to the compression chamber.

In accordance with a further aspect, a cycle of the apparatus comprises: loading the receiving chamber with the foodstuff, advancing the plunger to transfer the foodstuff into the compression chamber and to fill the receiving cavities with the foodstuff, ejecting the foodstuff from the cavities with the ejectors to transfer the foodstuff into the canning containers, and then retracting the plunger relative to the compression chamber and receiving chamber; and the control system is adjustable to set the travel end point of the plunger relative to the compression chamber resulting in setting the amount of foodstuff that remains in the compression chamber at the end of the cycle of the apparatus.

In a further aspect, the control system is adjustable to stop the movement of the plunger relative to the compression chamber so that a minimum amount of foodstuff remains in the compression chamber at the end of the plunger stroke.

In a further aspect, the control system is operable to control the amount of foodstuff that is fed into the infeed chamber depending on the stop location of the plunger relative to the compression chamber.

In a further aspect, the control system comprises a linear transducer, wherein as the plunger moves, the sensor moves along the linear transducer and the linear transducer produces an output signal related to the position of the sensor along the linear transducer.

In a further aspect, the control system is adjustable to stop the movement of the plunger relative to the compression chamber at a desired location so that a desired amount of foodstuff remains in the compression chamber at the end of the plunger travel toward the compression chamber.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
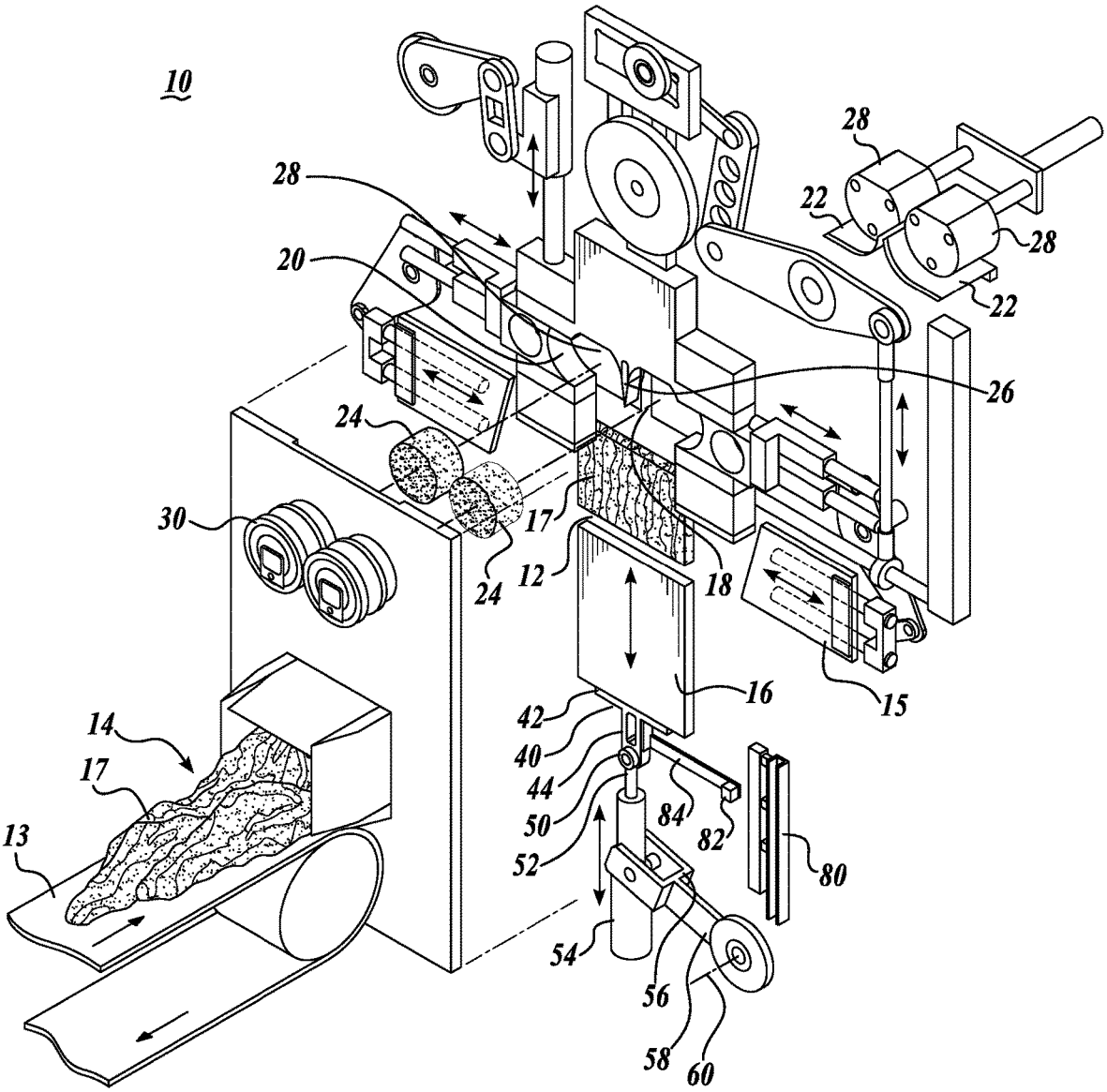
FIG. 1 is a front pictorial view, partially in schematic, of the apparatus for filling containers with shaped foodstuff in accordance with the present disclosure.

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "right-hand," "left-hand," "in," "out," "extended," "advanced," "retracted," "proximal," "distal," "central," etc. These references and other similar references in the present application are only to assist in helping describe and understand the present invention and are not intended to limit the present invention to these directions or locations. Also, references to "container," "can," or similar items are understood to be interchangeable and are not meant to be limiting in nature.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc. means plus or minus 5% of the stated value.

The present apparatus and method is applicable to various types of food that is placed into containers, such as cans. Such foods can include fish, meats, poultry, vegetables, etc. With respect to fish, various types can be processed via the previous disclosure, including, for example, tuna and salmon. The following description is in the context of canning fish. However, the apparatus and method of the present disclosure is not limited to fish.

The present application refers to "foodstuff," "foodstuff product," "food," "food products," and "food items." There is no differentiation among any of these terms, which are generic references to one type of work product with which the present apparatus and method are operable.

Referring initially to FIG. 1, an apparatus 10 for filling containers with foodstuffs, and in particular, canned containers with tuna, salmon, or other types of fish, is illustrated. The apparatus includes in basic form an infeed chamber or channel 12 for receiving fish fillets 17 from a conveyor belt 13 of a feed system 14. Powered, planar knives 15 are located at opposite sides of the chamber 12 to move toward each other to sever the leading portions of the fish fillets that have been fed from the conveyor 13 into the channel 12 from the remainder of the fillets. Thereafter, the channel 12 is closed off from the infeed belt 13 and then a plunger 16 pushes the fish 17, now loaded into the infeed channel 12, upwardly into an upper compression chamber 18.

The compression chamber 18 includes two circular cavities or lobes 20 disposed transversely to the travel direction of the plunger 16, into which the fish is pushed by the plunger 16 thereby to fill the cavities/lobes 20 with fish. Curved die cutters 22 shear the fish to form two cakes 24. A thin separating wedge 26 extends downwardly between the cavities/lobes 20 to cut the fish 17 into two separate cakes 24. Thereafter, a wall that initially closes off the front of the cavities/lobes 20 is retracted, and then pistons 28 are advanced into the cavities/lobes from behind to eject the formed cakes 24 out of the cavities/lobes 20 and into container cans 30 positioned in front of the cavities/lobes 20. Once filled, the container cans 30 may be transferred to subsequent processing stations, including for adding oil, water, or other liquid to the cans and then applying a cover to the cans.

Next, discussing aspects of the apparatus 10 in greater detail, the plunger 16 is generally rectangular in shape with a thickness that corresponds to the thickness of the infeed channel or chamber 12. The plunger 16 is constructed with a bottom connecting bracket 40 depending downwardly from the lower edge portion of the plunger 16. The connecting bracket 40 includes an upper bar portion 42 that is fixedly attached to the lower edge of the plunger 16. A pair of parallel arms 44 extend downwardly from bar portion 42 to terminate at a round collar portion 46 that receives a close-fitting pin 48 that extends through the collar portion 46 as well as through an upper distal circular eye 50 affixed to the upper end of rod 52 extending upwardly from an exterior cylindrical housing 54. The cylindrical housing 54 is pinned to the clevis portion 56 of the pivot arm 58 that oscillates about a pivot axis 60 by a power source, not shown. Also, in the interior of the cylindrical housing, a compression spring acts between the rod 52 and the housing 54 so that an adjustable maximum compression force can be applied to the fish 17 in the channel 12 by the plunger 16. Other ways of attaching the rod 52 to the plunger 16 can be utilized: for example, a ball joint may be employed.

Figure 3:
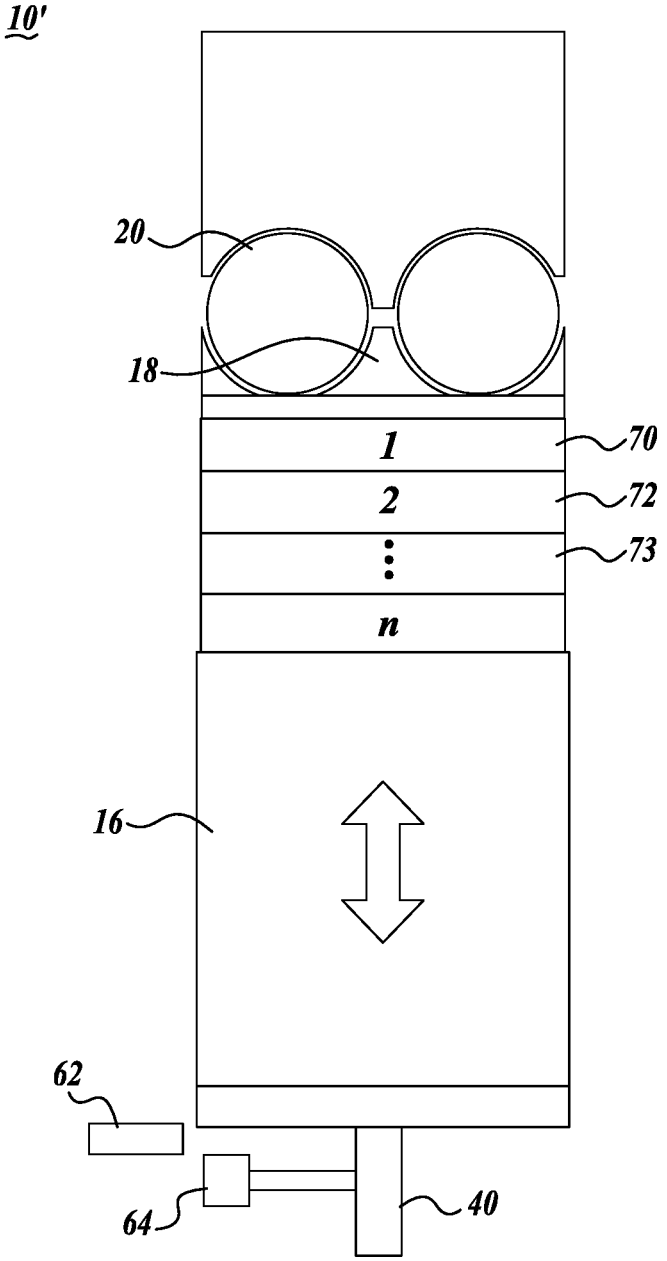
Fig.3. (PRIOR ART)
FIG. 3 is a schematic view of a prior art apparatus and method for filling containers with a shaped foodstuff product.

Next, referring to FIG. 3, a prior art fish canning apparatus 10' is schematically illustrated. During a normal cycle, there is an overfeed of fish within the compression chamber. As noted above, there will always need to be a certain amount of product/fish overfeed just to make certain that there is always enough fish in the compression chamber to fill the lobes 20. In FIG. 3, after a first cycle of the plunger 16, meaning after the plunger pushes the fish from the infeed channel 12 into the compression chamber 18, including to fill lobes 20, the quantity of leftover fish can be identified by the volume 70. A fixed location digital sensor 62 detects a flag 64, which moves vertically with the connecting bracket 40 attached to the lower edge of plunger 16. The sensor 62 senses the flag passing by the sensor during the upward movement of the plunger 16. This initiates the feeding of the fish fillets into the infeed channel 12 from the conveyor belt 13 for the next cycle.

At the end of the second cycle, an additional quantity of extra fish will have accumulated, which is designated in FIG. 3 as quantity 72. Thus, at the end of the second cycle, the extra or spare fish consists of quantities 70 and 72. When the plunger 16 rises upwardly during the second cycle, the flag 64 again passes the sensor 62 whereby a further quantity of fish fillet is fed into the infeed channel 12. At cycle N, the extra tuna accumulated will be in the quantity totaling 70+72+. . . N. Eventually, the sensor will not sense the flag since the flag will not rise to the elevation of the sensor. When this occurs, the infeed belt 13 is disabled. In this situation, there is now enough leftover fish in the infeed chamber for a cycle of the apparatus to take place without need of any further fish to be added to the infeed channel 12. Typically, after from about 5 to 10 cycles, there is sufficient accumulated fish in the infeed chamber 12 for a fill cycle to take place without the need of any more fish to be fed into the infeed chamber.

It can be appreciated that this accumulated fish may have been compressed several times before it is eventually loaded into the cans/containers 30. This means that the fish at the top of the infeed channel at cycle N may have originated from two cycles ago, or perhaps even earlier than that. As a consequence, such fish may be overly compressed by the time it finally is loaded into a can. As such, the fish may have lost its naturally appearing and appealing texture or appearance. Moreover, the overly compressed fish will absorb oil, water, or other liquid differently. As a result, the quality of the fish offered to the consumer may not be to a standard that is desired.

Figure 2:
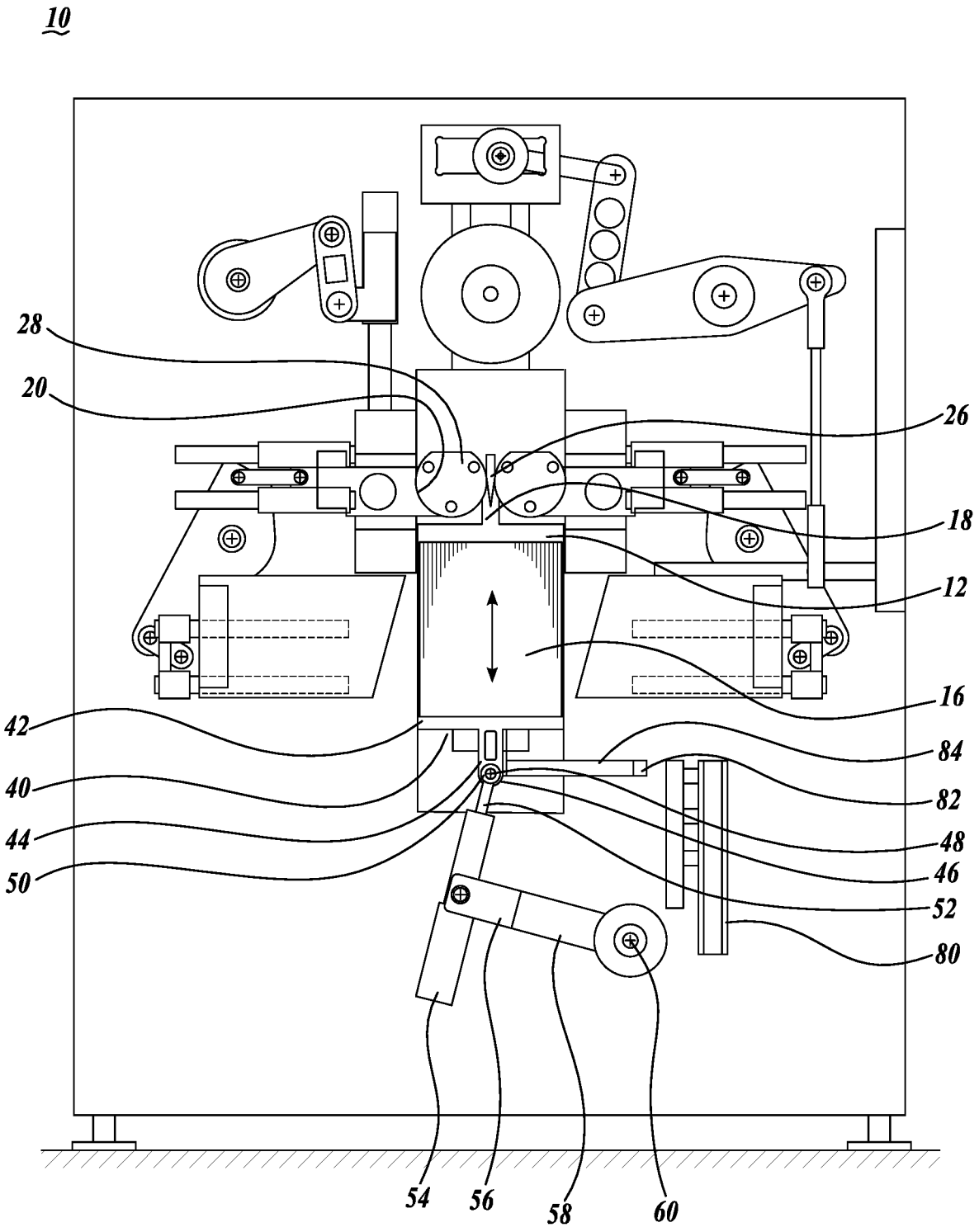
FIG. 2 is a partially schematic front view of FIG. 1.

As shown in FIGS. 1 and 2, the apparatus 10 of the present disclosure is designed so that the upper end of the plunger 16 terminates at the same adjustable position relative to the compression chamber 18 at the end of each plunger stroke. This end position of the plunger is used to determine the operation of the feed system that feeds the fish 17 from the infeed belt 13 into the channel 12. This allows a known and constant volume of fish 17 to be loaded from the belt 13 into the channel 12 during each cycle of the apparatus 10. In this regard, the end of the plunger stroke is set so that a very minimum quantity of fish remains in the compression chamber 18 after the lobes 20 are emptied into the can containers 30. In this manner, only a very small proportion of the fish that is transferred into the container cans with each cycle of the apparatus 10 has been previously compressed; instead, virtually all of the fish being placed in the container cans deriving from a single stroke of the plunger 16.

The end stroke of the plunger 16 is detected and then set through the use of an elongate linear transducer 80 disposed stationary and parallel to the travel direction of the plunger 16, as shown in FIGS. 1 and 2. A magnetic sensor 82 is mounted on the distant end of arm 84 projecting laterally from connecting bracket 40 to a location adjacent the longitudinal transducer. The linear transducer 80 together with the magnetic sensor 82 enables the position of the plunger 16 to always be known and precisely controlled.

As the magnetic sensor 82 moves along the transducer unit 80, the output voltage signal (or perhaps a current signal) generated by the transducer changes indicates the precise location of the magnetic sensor along the length of the transducer. Such output signal can be used to set the stroke of the plunger 16, including its initial (bottom) end point, and end (top) point set point. Thus the linear transducer can be set up to control the stroke of the plunger. The output from the transducer is used to control the operation of the fish feed system 14 so that a desired quantity of fish 17 is delivered from the infeed belt into the infeed channel 12. Further, it will be appreciated that because the sensor 82 is separate and sealed relative to the transducer 80, the transducer can enjoy a very long life cycle, perhaps virtually indefinite if properly utilized. Moreover, linear transducers, such as linear transducer 80, are designed to operate in wide temperature ranges and are able to withstand high vibration and shock levels. Further, such transducers have low hysteresis and excellent repeatability. Linear transducers, such as linear transducer 80, are articles of commerce.

Also, the apparatus 10 can be controlled to load the chamber 12 with a desired quantity/volume of fish from belt 13 to be pushed upwardly into the compression chamber 18 by the plunger 16 thereby to load the lobes 20. This quantity of fish is determined by the operation of the fish feed system 14. Thus, it is possible to limit or control the extent to which the fish is compressed by the plunger 16 during the process of filling the can containers. In this regard, it is desirable to not over-compress the fish so that the fish retains a natural appearance when placed within the can containers.

As will be appreciated, the use of the linear transducer 80 enables the quantity of fish that remains within the compression chamber 18 to be calculated when the plunger 16 has reached the end of its stroke. As noted above, it is desirable that a bare minimum amount of fish remains within the compression chamber 18 at the end of a fill cycle. This information is used to determine how much fish is to be loaded from the belt 13 into the infeed chamber 12 for the next loading operation. Such amount of fish is set so that at the end of the fill cycle, the plunger 16 always stops at the same elevation or location relative to the compression chamber 18. The amount of fish placed within the containers by the apparatus 10 is always the same (determined by the fish volume times the fish density). In this manner, the texture and appearance of the fish can be controlled, since the fish is not being compressed multiple times before being placed into the canning containers.

While illustrative embodiments have been illustrated and described, it will be appreciated that various changes can be made therein without departing from the spirit and scope of the invention. For example, although two cavities or lobes 20 are shown and described above, it is to be understood that a different number of cavities or lobes can be utilized, for example, 1, 3, 4, etc.

Also, the above arrangement may be replaced with an actuator wherein the rod 52 is directly powered to advance and retract up and down. In this regard, an actuator can be used that employs a brushless piston to power the rod 52. Such brushless actuators are articles of commerce. The use of a brushless piston system will enable the stroke of and force applied by the plunger to be accurately controlled as desired since the position of the plunger 16 and the force being applied to the plunger will always be known. Thus, the use of the brushless piston eliminates the need for the linear transducer described above. Nonetheless, the linear transducer can be used to provide redundancies to apparatus 10.

The invention claimed is:

1. An apparatus for filling canning containers with a foodstuff by pushing a desired quantity of the foodstuff into the canning containers in cycles to fill the canning containers, the apparatus limiting the density of the foodstuff placed into the canning containers by limiting the number of cycles that the foodstuff is pushed in order to fill the canning containers by minimizing a quantity of remaining foodstuffs not pushed into the canning containers at the end of a can filling cycle, the apparatus comprising:

a receiving channel for receiving sliced pieces of a foodstuff;

a compression chamber in registry with the receiving channel, the compression chamber comprising one or more foodstuff receiving cavities;

a plunger for transferring the foodstuff from the receiving channel into the compression chamber, including into the one or more foodstuff receiving cavities, the plunger being powered to travel along a compression stroke of a selective, adjustable distance through the compression chamber to force the foodstuff into the one or more foodstuff receiving cavities until the compression stroke reaches an end;

ejectors slidably engageable into the one or more foodstuff receiving cavities for ejecting the foodstuff from the one or more foodstuff receiving cavities and into the canning containers positioned in registry with the one or more foodstuff receiving cavities;

a linear displacement measurement device to monitor the location and movement of the plunger comprising:

a stationary signal generator extending along the direction of travel of the plunger; and a sensor mounted to travel with the plunger to produce an output signal corresponding to the location of the plunger relative to the receiving channel and the compression chamber; and a control system receiving output signals from the stationary signal generator to:

(a) control the amount of foodstuff transferred from the receiving channel to the compression chamber by controlling and monitoring the location and travel of the plunger from the receiving chamber to the compression chamber;

(b) determine the amount of foodstuff remaining in the compression chamber when the plunger has reached the end of the compression stroke of the plunger;

(c) minimize the amount of foodstuff remaining in the compression chamber at the end of the cycle of the apparatus for filling the canning containers by controlling and adjusting the end of the compression stroke of the plunger relative to the compression chamber to position the plunger at the end of the compression stroke relative to the foodstuff receiving cavities; and whereby the number of cycles of the apparatus that the foodstuff is pushed by the plunger before entering the canning container is limited, thereby in turn limiting the density of the foodstuff placed into the canning container.

2. The apparatus according to claim 1, wherein the receiving channel is of a rectangular shape.

3. The apparatus according to claim 1, wherein the plunger is configured to push against a foodstuff loaded into the receiving channel to transfer the foodstuff into the compression chamber.

4. The apparatus according to claim 1, wherein the ejectors comprise pistons slidably engageable into the one or more foodstuff receiving cavities for pushing a foodstuff out of the one or more foodstuff receiving cavities and into the canning container positioned in registry with the one or more foodstuff receiving cavities.

5. The apparatus according to claim 1, wherein the control system stops the movement of the plunger relative to the compression chamber, resulting in a minimum amount of the foodstuff remaining in the compression chamber at the end of the compression stroke.

6. The apparatus according to claim 1, wherein the control system controls the foodstuff amount that is fed into the compression chamber depending upon the compression stroke of the plunger relative to the compression chamber.

7. The apparatus according to claim 1, wherein the stationary signal generator comprises a linear transducer, and the sensor is spaced away from the linear transducer.

8. The apparatus according to claim 7, wherein:

as the plunger moves, the sensor moves along the linear transducer in spaced relationship to the exterior of the linear transducer; and the linear transducer produces an output signal related to the position of the sensor along the linear transducer.

9. The apparatus according to claim 8, wherein the structure of the linear transducer is electromechanical, and the structure of the sensor is magnetic.

10. The apparatus according to claim 8, wherein the output signal produced by the linear transducer is an electrical voltage signal or an electric current signal.

11. The apparatus according to claim 1, wherein the control system controls the amount of foodstuff that is loaded into the receiving channel.

12. The apparatus according to claim 11, wherein the amount of foodstuff loaded into the receiving channel is based on the amount of foodstuff remaining in the compression chamber when the plunger has reached the end of the compression stroke of the plunger.

13. An apparatus for filling canning containers with a foodstuff by cyclically pushing the foodstuff into the canning containers, the apparatus limiting the number of cycles used to push the foodstuff in order to fill the canning container, comprising:

a receiving channel for receiving the foodstuff;

a compression chamber in registry with the receiving channel, the compression chamber comprising one or more foodstuff receiving cavities;

a plunger operable along an adjustable length advancing stroke for movement of the foodstuff from the receiving channel into the compression chamber, including into the one or more foodstuff receiving cavities and along a retracting stroke to a retracted position relative to the receiving channel;

ejectors slidably engageable into the one or more foodstuff receiving cavities for ejecting the foodstuff from the one or more foodstuff receiving cavities and into the canning containers positioned in registry with the one or more foodstuff receiving cavities;

a monitoring system to monitor the location and travel of the plunger relative to the receiving channel and the compression chamber; and a control system receiving output signals from the monitoring system to:

control the amount of foodstuff transferred from the receiving channel to the compression chamber by controlling and monitoring the location and travel of the plunger from the receiving chamber to the compression chamber;

determine the amount of foodstuff remaining in the compression chamber when the plunger has reached the end of the compression stroke of the plunger;

minimize the amount of foodstuff remaining in the compression chamber at the end of the cycle of the apparatus for filling the canning containers by controlling and adjusting the advancing stroke of the plunger relative to the compression chamber and the receiving channel and stop the advancing stroke of the plunger at a position adjacent the foodstuff receiving cavities.

14. The apparatus according to claim 13, wherein the control system comprises a linear displacement measuring device monitoring the travel and location of the plunger.

15. The apparatus according to claim 14, wherein the linear displacement measuring device comprises:

a stationary signal generator extending along the direction of travel of the plunger; and a sensor spaced away from the stationary signal generator and mounted to travel with the plunger to produce an output signal corresponding to the location of the plunger relative to the receiving channel and the compression chamber.

16. The apparatus according to claim 13, wherein the control system is adjustable to set the end point location of the travel of the plunger relative to the location of the compression chamber.

17. The apparatus according to claim 13, wherein the amount of foodstuff that is fed into the compression chamber depends upon the stop location of the plunger advancing stroke relative to the compression chamber.

* * * * *